US011624098B2

(12) United States Patent
Andersson

(10) Patent No.: US 11,624,098 B2
(45) **Date of Patent: *Apr. 11, 2023**

(54) PRECIPITATION HARDENING STEEL AND ITS MANUFACTURE

(71) Applicant: OVAKO SWEDEN AB, Hofors (SE)

(72) Inventor: Jan-Erik Andersson, Falun (SE)

(73) Assignee: OVAKO SWEDEN AB, Hofors (SE)

( * ) Notice: Subject to any disclaimer, the term of this patent is extended or adjusted under 35 U.S.C. 154(b) by 0 days.

This patent is subject to a terminal disclaimer.

(21) Appl. No.: 16/306,454

(22) PCT Filed: May 31, 2017

(86) PCT No.: PCT/EP2017/063192

§ 371 (c)(1),
(2) Date: Nov. 30, 2018

(87) PCT Pub. No.: WO2017/207651

PCT Pub. Date: Dec. 7, 2017

(65) Prior Publication Data

US 2019/0127815 A1 May 2, 2019

(30) Foreign Application Priority Data

Jun. 1, 2016 (SE) ..... 1650764-2

(51) Int. Cl.

| | |
|---|---|
| ***C21D 6/02*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C21D 1/25*** | (2006.01) |
| ***C22C 38/08*** | (2006.01) |
| ***C22C 38/12*** | (2006.01) |
| ***C22C 38/40*** | (2006.01) |
| ***C21D 6/00*** | (2006.01) |
| ***C21D 1/06*** | (2006.01) |
| ***C23C 8/02*** | (2006.01) |
| ***C23C 8/26*** | (2006.01) |
| *C21D 1/18* | (2006.01) |

(52) U.S. Cl.

CPC ..... *C21D 6/02* (2013.01); *C21D 1/06* (2013.01); *C21D 1/25* (2013.01); *C21D 6/004* (2013.01); *C21D 6/005* (2013.01); *C21D 6/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/40* (2013.01); *C22C 38/44* (2013.01); *C22C 38/46* (2013.01); *C23C 8/02* (2013.01); *C23C 8/26* (2013.01); *C21D 1/18* (2013.01); *C21D 2211/001* (2013.01); *C21D 2211/004* (2013.01); *C21D 2211/008* (2013.01)

(58) Field of Classification Search

CPC ..... C21D 6/02

See application file for complete search history.

(56) References Cited

U.S. PATENT DOCUMENTS

| | | | | |
|---|---|---|---|---|
| 3,619,179 | A | 11/1971 | Malagari et al. | |
| 5,393,488 | A | 2/1995 | Rhoads et al. | |
| 6,193,469 | B1 * | 2/2001 | Tsuda | C21D 9/38 148/609 |
| 2013/0224033 | A1 * | 8/2013 | Arai | F01D 5/28 416/223 R |
| 2019/0127814 | A1 * | 5/2019 | Andersson | C21D 6/02 |

FOREIGN PATENT DOCUMENTS

| | | | |
|---|---|---|---|
| EP | 0867522 | A2 | 9/1998 |
| EP | 2377962 | A1 | 10/2011 |
| JP | 02310339 | A | 12/1990 |
| JP | 0463261 | A | 2/1992 |

OTHER PUBLICATIONS

English machine translation of JP H04-063261 A of Moriyama published Feb. 28, 1992 (Year: 1992).*

* cited by examiner

*Primary Examiner* — Jophy S. Koshy
(74) *Attorney, Agent, or Firm* — Porter Wright Morris & Arthur LLP

(57) ABSTRACT

There is provided a precipitation hardening steel with the composition: C: 0.05-0.30 wt %, Ni: 3-9 wt %, Mo: 0.5-1.5 wt %, Al: 1-3 wt %, Cr: 2-14 wt %, V: 0.25-1.5 wt %, Co: 0-0.03 wt %, Mn: 0-0.5 wt %, Si: 0-0.3 wt %, and remaining part up to 100 wt % is Fe and impurity elements, with the additional proviso that the amounts of Al and Ni also fulfil Al=Ni/3±0.5 in wt %. There is the possibility to have very low amounts of cobalt, well below 0.01 wt %. The precipitation hardening steel displays, low segregation, high yield strength at elevated temperatures, high resistance against corrosion, and can also suitably be nitrided. The precipitation hardening steel is more economical to manufacture compared to steel according to the state of the art with the same strength at elevated temperatures.

12 Claims, 6 Drawing Sheets

| | C | Si | Mn | Cr | Mo | V | Ni | Al |
|---|---|---|---|---|---|---|---|---|
| Invented Steel | 0.2 | 0.1 | 0.3 | 5 | 0.7 | 0.5 | 6 | 2 |
| Steel 1 | 0.2 | 0.1 | 0.3 | 5 | 0.7 | 0.5 | 0.1 | 0.025 |
| Steel 2 | 0.2 | 0.1 | 1 | 1 | 0.05 | 0.05 | 0.1 | 0.025 |

| | C | Ni | Mo | Al | Cr | Mn | Si | Ti | Co | V |
|---|---|---|---|---|---|---|---|---|---|---|
| Steel 1 | 0.03 | 18 | 4.9 | 0.1 | 0.1 | 0.1 | 0.1 | 0.6 | 8 | 0.05 |
| Steel 2 | 0.03 | 9.2 | 1.4 | 1.6 | 12 | 0.3 | 0.3 | 0.002 | 0.05 | 0.05 |
| Steel 3 | 0.2 | 6 | 0.7 | 2 | 5 | 0.3 | 0.1 | 0.002 | 0.05 | 0.05 |
| Steel 4 | 0.65 | 0.05 | 3.5 | 0.025 | 1.5 | 0.2 | 0.5 | 0.002 | 0.05 | 0.6 |
| Steel 5 | 0.8 | 0.05 | 4.25 | 0.025 | 4 | 0.2 | 0.2 | 0.002 | 0.05 | 1 |
| Steel 6 | 1 | 0.05 | 0.55 | 0.025 | 2 | 1 | 0.5 | 0.002 | 0.05 | 0.05 |
| Steel 7 | 0.3 | 0.05 | 2 | 0.025 | 1.7 | 0.5 | 0.2 | 0.002 | 0.05 | 0.5 |
| Steel 8 | 0.2 | 0.05 | 0.3 | 0.025 | 1.1 | 0.8 | 0.8 | 0.002 | 0.05 | 0.1 |

| | C | Si | Mn | Cr | Mo | V | Ni | Al | |
|---|---|---|---|---|---|---|---|---|---|
| Invented Steel | 0.2 | 0.1 | 0.3 | 5 | 0.7 | 0.5 | 6 | | 2 |
| Steel 1 | 0.65 | 1.5 | 1.5 | 1.1 | 0.25 | 0.1 | 0.1 | | 0.025 |
| Steel 2 | 0.95 | 0.3 | 0.3 | 1.5 | 0.05 | 0.05 | 0.1 | | 0.025 |
| Steel 3 | 0.95 | 0.6 | 1.1 | 1.5 | 0.05 | 0.05 | 0.1 | | 0.025 |
| Steel 4 | 0.8 | 0.4 | 0.25 | 4 | 4.25 | 1 | 0.1 | | 0.025 |

| | C | Si | Mn | Cr | Mo | V | Ni | Al |
|---|---|---|---|---|---|---|---|---|
| Invented Steel | 0.2 | 0.1 | 0.3 | 5 | 0.7 | 0.5 | 6 | 2 |
| Steel 1 | 1 | 0.3 | 0.3 | 1.5 | 0.05 | 0.05 | 0.05 | 0.025 |
| Steel 2 | 0.4 | 0.25 | 0.8 | 1 | 0.2 | 0.05 | 0.1 | 0.025 |

| | C | Si | Mn | Cr | Mo | V | Ni | Al |
|---|---|---|---|---|---|---|---|---|
| Invented Steel | 0.2 | 0.1 | 0.3 | 5 | 0.7 | 0.5 | 6 | 2 |
| Steel 1 | 1 | 0.3 | 0.3 | 1.5 | 0.05 | 0.05 | 0.05 | 0.025 |

PRECIPITATION HARDENING STEEL AND ITS MANUFACTURE

TECHNICAL FIELD

The present invention relates generally to high strength precipitation hardening steel suitable for use at elevated temperature. The precipitation hardening steel composition is optimized to give both precipitation hardening with carbides together with an inter-metallic precipitation of Ni—Al present after tempering. The new precipitation hardening steel is designed to have a low micro and macro segregation. It is possible to provide a precipitation hardening steel which is essentially cobalt free.

BACKGROUND

Primary hardening is when the steel is quenched from the austenitic phase field into a martensitic or bainitic microstructure. Generally steels comprising carbides are known. Low alloy carbon steels generates iron carbides during tempering. These carbides coarsen at elevated temperatures which reduces the strength of the steel. When steels contain strong carbide forming elements such as molybdenum, vanadium and chromium, the strength can be increased by prolonged tempering at elevated temperatures. This is due to that alloyed carbides will precipitate at certain temperatures. Normally these steels reduce their primary hardened strength when tempered at 100° C. to 450°. At 450° C. to 550° C. these alloyed carbides precipitate and increase the strength up to or even higher than the primary hardness, this is called secondary hardening. It occurs since the alloying elements (such as molybdenum, vanadium and chromium) can diffuse during prolonged annealing to precipitate finely dispersed alloy carbides. The alloy carbides found in secondary hardened steels are thermodynamically more stable than iron carbides and show little tendency to coarsen. Tempering characteristics for various steels can be seen in FIG. 1.

Inter metallic precipitation hardening steels are also known. Both the carbide precipitation and inter metallic precipitation hardening relies on changes in solid solubility with temperature to produce fine particles of an impurity phase, which impede the movement of dislocations, or defects in a crystal lattice. Since dislocations are often the dominant carriers of plasticity, this serves to harden the material. Precipitation hardening steels may for instance comprise aluminum and nickel, forming the impurity phase.

The presence of second phase particles often causes lattice distortions. These lattice distortions result when the precipitate particles differ in size and crystallographic structure from the host atoms. Smaller precipitate particles in a host lattice leads to a tensile stress, whereas larger precipitate particles leads to a compressive stress. Dislocation defects also create a stress field. Above the dislocation there is a compressive stress and below there is a tensile stress. Consequently, there is a negative interaction energy between a dislocation and a precipitate that each respectively cause a compressive and a tensile stress or vice versa. In other words, the dislocation will be attracted to the precipitate. In addition, there is a positive interaction energy between a dislocation and a precipitate that have the same type of stress field. This means that the dislocation will be repulsed by the precipitate.

Precipitate particles also serve by locally changing the stiffness of a material. Dislocations are repulsed by regions of higher stiffness. Conversely, if the precipitate causes the material to be locally more compliant, then the dislocation will be attracted to that region.

Steels comprising both alloy carbides and intermetallic precipitates are rare, but they are known. Those steels are however not optimized for low segregation or for optimized hardness after tempering. For instance U.S. Pat. No. 5,393,488 discloses a steel with a duplex hardening mechanism both with intermetallic precipitates and alloy carbides. This steel comprises C: up to 0.30 wt %
Ni: 10-18 wt %
Mo: 1-5 wt %
Al: 0.5-1.3 wt %
Cr: 1-3 wt %
Co: 8-16 wt %.

It is known that cobalt has negative health effects as well as negative environmental effects. At the same time it is desirable to increase the desired properties in general and in particular the strength at high temperature.

Every steel grade will segregate more or less depending on steel composition. Numerous of steel grades have been examined for the variations of chemical compositions. The various elements in normal steelmaking and the tendency to segregate can be seen in FIG. 2. The higher the value of the segregation index, the more it will segregate. Carbon has an enormous influence on the partitioning of various carbide forming elements, such as Mo Cr and V. The higher the carbon content, the more segregation will occur. Both on a micro and a macro scale. Segregation of various steels can be seen in FIG. 3. The absolute value of Cr, Mo or V will be the segregation index multiplied with the nominal content of the steel. Since chromium has a low tendency to segregate, a loose restriction of the amount can be set. The amount of Mo and V on the other hand should be controlled up to 1.0-1.5 wt % because of their tendency to segregate.

M-50 steel is often refined using vacuum-induction melting (VIM) and vacuum-arc remelting (VAR) processes, and it exhibits excellent resistance to multi-axial stresses and softening at high service temperatures as well as good resistance to oxidation. However it suffers from segregation, as can be seen in FIG. 3, which would be desirable to avoid. Further it is fairly expensive to manufacture.

In view of this it is a problem in the art how to provide a steel where it is possible to have negligible amounts of cobalt which at the same time has both low segregation and improved mechanical properties also at elevated temperatures.

SUMMARY

It is an object of the present invention to obviate at least some of the disadvantages in the prior art and provide an improved precipitation hardening steel.

In a first aspect there is provided a precipitation hardening steel with the composition:

C: 0.05-0.30 wt %
Ni: 3-9 wt %
Mo: 0.5-1.5 wt %
Al: 1-3 wt %
Cr: 2-14 wt %
V: 0.25-1.5 wt %
Co: 0-0.03 wt %
Mn: 0-0.5 wt %
Si: 0-0.3 wt % remaining part up to 100 wt % is Fe and impurity elements, with the additional proviso that the amounts of Al and Ni also fulfil the formula Al=(Ni/3)±0.5 in wt %, with the proviso that the amount of Al is 1 wt % if the formula results in an amount of Al lower than 1 wt % and that the amount of Al is 3 wt % if the formula results in an amount of Al exceeding 3 wt %.

The relation between Al and Ni is selected because the optimum usage of Ni and Al will be according to their atomic masses when precipitates of Ni and Al are formed.

In a second aspect there is provided a method of manufacturing a part of the precipitation hardening steel described above characterized in that the precipitation hardening steel is tempered at 510-530° C. to obtain precipitates comprising Ni and Al.

In a third aspect there is provided use of the precipitation hardening steel as described above for applications where the precipitation hardening steel is subjected to a temperature during use from 250 to 300° C. In an alternative embodiment there is provided use of the precipitation hardening steel described above for applications where the precipitation hardening steel is subjected to a temperature during use from 300 to 500° C. In yet another embodiment there is provided use of the precipitation hardening steel as described above for applications where the precipitation hardening steel is subjected to a temperature during use from 250 to 500° C.

Further aspects and embodiments are defined in the appended claims.

One advantage is that the precipitation hardening steel can be provided with only trace amounts of undesired cobalt. It is possible to use cobalt levels well below 0.01 wt %. The amounts are so low that any undesired effects are avoided. Low amounts of cobalt are preferred because of the environmental and health problems associated with cobalt.

Another advantage is that the strength at elevated temperatures is increased. Elevated temperatures where the strength is increased are typically 250-300° C. or even up to 500° C. In one embodiment the upper temperature limit for the suitable use of the precipitation hardening steel is 450° C.

The precipitation hardening steel is more economical to manufacture compared to present precipitation hardening steels with the same strength at elevated temperatures. The precipitation hardening steel according to the invention has the same strength at 250° C. as precipitation hardening steel 4 in FIG. 4, precipitation hardening steel 4 is M50, which is more expensive to manufacture since a different and more expensive process, such as remelting using ESR or VAR is required.

Yet another advantage is that the precipitation hardening steel is suitable for nitriding.

BRIEF DESCRIPTION OF THE DRAWINGS

The invention is now described, by way of example, with reference to the accompanying drawings, in which.

DETAILED DESCRIPTION

Figure 1:
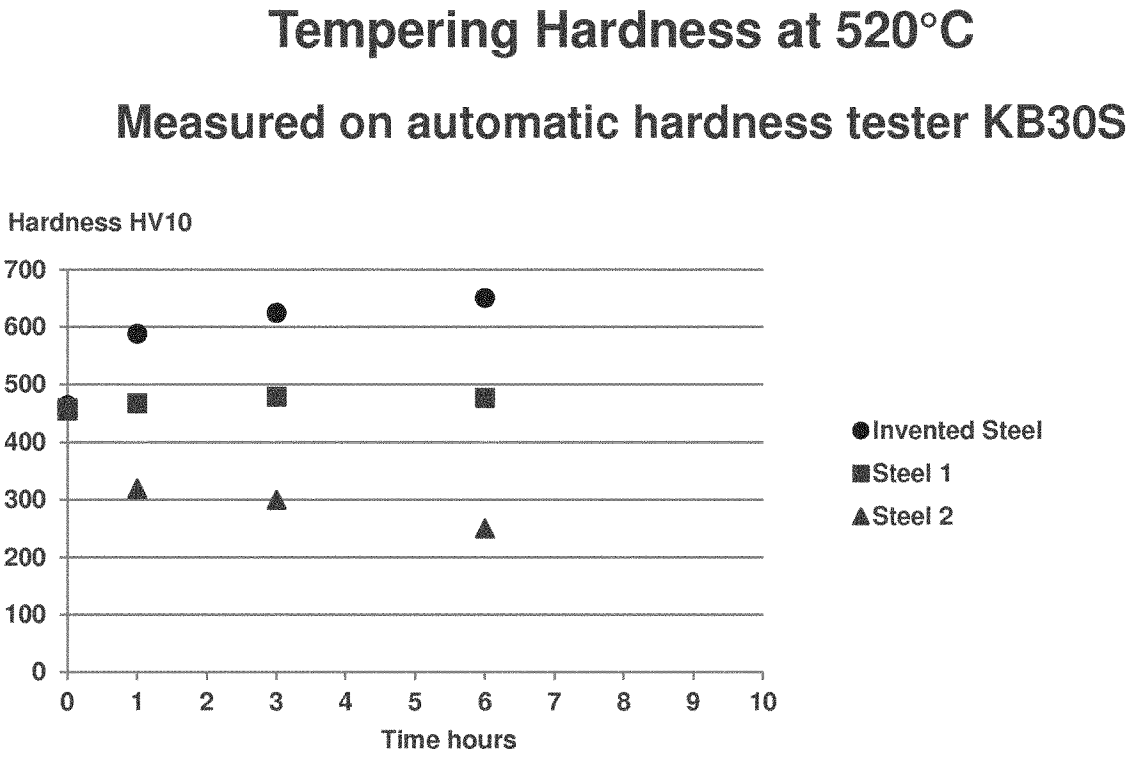
FIG. 1 shows the tempering hardness after tempering at 520° C. as a function of tempering time. The precipitation hardening steel according to the invention is compared to two other steels. The hardness HV10 is determined using a calibrated hardness tester KB30S. The amounts of elements in the different steels in the table are given in wt %.
Figure 2:
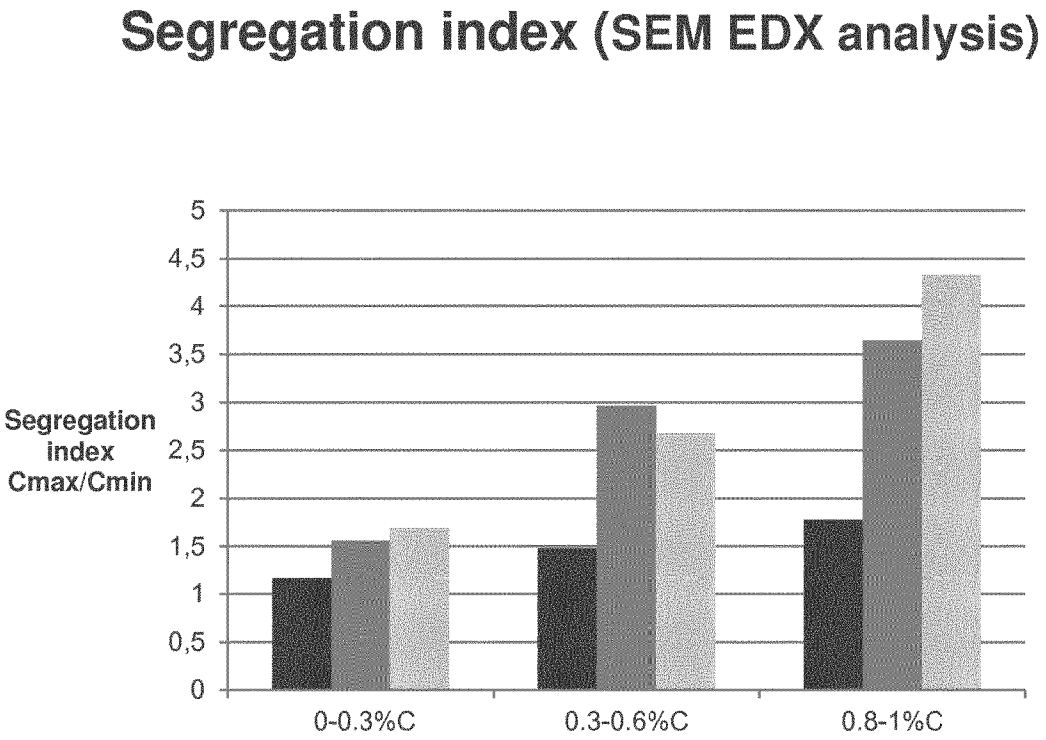
FIG. 2 shows various elements in normal steelmaking (Cr, Mo, and V) and their tendency to segregate for different ranges of carbon. The steel compositions 1-8 disclosed in the table in FIG. 2 are the steel compositions for which the segregation index has been measured and calculated in FIG. 2.

Before the invention is disclosed and described in detail, it is to be understood that this invention is not limited to particular compounds, configurations, method steps, substrates, and materials disclosed herein as such compounds, configurations, method steps, substrates, and materials may vary somewhat. It is also to be understood that the terminology employed herein is used for the purpose of describing particular embodiments only and is not intended to be limiting since the scope of the present invention is limited only by the appended claims and equivalents thereof.

It must be noted that, as used in this specification and the appended claims, the singular forms "a", "an" and "the" include plural referents unless the context clearly dictates otherwise.

If nothing else is defined, any terms and scientific terminology used herein are intended to have the meanings commonly understood by those of skill in the art to which this invention pertains.

Essentially cobalt free and similar expressions mean that only trace amounts of cobalt are present. In one embodiment essentially cobalt free is an amount below a suggested threshold for cobalt of 0.01 wt %.

All percentages are calculated by weight, unless otherwise clearly indicated. The composition of steels are given in wt %. All ratios are calculated by weight, unless otherwise clearly indicated.

In a first aspect there is provided a precipitation hardening steel with the composition:

C: 0.05-0.30 wt %
Ni: 3-9 wt %
Mo: 0.5-1.5 wt %
Al: 1-3 wt %
Cr: 2-14 wt %
V: 0.25-1.5 wt %
Co: 0-0.03 wt %
Mn: 0-0.5 wt %
Si: 0-0.3 wt % remaining part up to 100 wt % is Fe and impurity elements, , with the additional proviso that the amounts of Al and Ni also fulfil the formula (Al=Ni/3)±0.5 in wt %, with the proviso that the amount of Al is 1 wt % if the formula results in an amount of Al lower than 1 wt % and that the amount of Al is 3 wt % if the formula results in an amount of Al exceeding 3 wt %.

The amounts of all elements are in wt %.

Carbon (C): 0.05 to 0.3 wt %. C is a strong austenite phase stabilizing alloying element. C is necessary for the precipitation hardening steel so that said precipitation hardening steel has the ability to be hardened and strengthened by heat treatment. An excess of C will increase the risk of forming chromium carbide, which would thus reduce various mechanical properties and other properties, such as ductility, impact toughness and corrosion resistance. The mechanical properties are also affected by the amount of retained austenite phase after hardening and this amount will depend on the C-content. Accordingly, the C-content is set to be at most 0.3 wt %.

Nickel (Ni) 3-9 wt %. Ni is an austenite phase stabilizing alloying element and thereby stabilize an austenite phase after a hardening heat treatment. It has also been discovered that Ni will provide a much improved impact toughness in addition to the general toughness contribution which is provided by a retained austenite phase. In the present disclosure, it has been found that by balancing the amount of Ni and Al a first type of precipitations comprising Al and Ni are obtained. Thus the amount of Ni should be balanced with the amount of Al to fulfil the formula in the claim.

Molybdenum (Mo): 0.5-1.5 wt %. Mo is a strong ferrite phase stabilizing alloying element and thus promotes the formation of the ferrite phase during annealing or hot-working. One major advantage of Mo is that it contributes to the corrosion resistance. Mo is also known to reduce the temper embrittlement in martensitic steels and thereby improves the mechanical properties. However, Mo is an expensive element and the effect on corrosion resistance is obtained even in low amounts. The lowest content of Mo is therefore 0.5 wt %. Furthermore, an excessive amount of Mo affects the austenite to martensite transformation during hardening and eventually the retained austenite phase content. Therefore, the upper limit of Mo is set at 1.5 wt %.

Aluminum (Al) 1-3 wt %. Al is an element commonly used as a deoxidizing agent as it is effective in reducing the oxygen content during steel production. In the steel aluminum forms a first type of precipitations together with Ni to improve the mechanical properties. The relation between Al and Ni is determined by the formula Al=Ni/3 and adding the marginal ±0.5 wt %. The formula Al=Ni/3±0.5 should be used with the amounts of Al and Ni expressed in weight percent. The formula gives an additional condition to be fulfilled together with all other conditions. Assuming that Ni=9 wt %, then this formula gives that Al=3±0.5 wt %, i.e. in the interval 2.5 to 3.5 wt %. However there is also the condition that the amount of Al is 1-3 wt %. The latter condition shall in the present disclosure be interpreted so that if the first formula gives an amount of Al which is 3 wt % or higher, then 3 wt % Al should be used. If the first formula gives an amount of Al which is 1 wt % or lower, then 1 wt % Al should be used. Thus the formula gives an additional condition which should be applied together with the other conditions regarding the amounts of Al and Ni. Both conditions shall be applied. In this particular example the amount of Al becomes 2.5 to 3.0 wt % since value given by the formula 3.5 is replaced by 3.0. Assuming that Ni=3 wt %, then this formula gives that Al=1±0.5 wt %. However there is also the condition that the amount of Al is 1-3 wt %. These conditions together give that Al should be between 1 and 1.5. The ratio of Al and Ni is selected because the optimum usage of Ni and Al will be according to their atomic masses when precipitates of N: Al is formed.

Chromium (Cr) 2-14 wt % is one of the basic alloying elements of a steel and an element which will provide corrosion resistance to the steel by forming a protective layer of chromium oxide on the surface. Cr is also a ferrite phase stabilizing alloying element. However, if Cr is present in an excessive amount, the impact toughness may be decreased and additionally ferrite phase and chromium carbides may be formed upon hardening. The formation of chromium carbides will reduce the mechanical properties of the precipitation hardening steel. In one embodiment the amount of Cr is in the interval 2-10 wt %. This chromium level is just below the limit for a stainless steel.

Vanadium (V): 0.25-1.5 wt %. V is a ferrite phase stabilizing alloying element which has a high affinity to C and N. V is a precipitation hardening element and is regarded as a micro-alloying element in the precipitation hardening steel and may be used for grain refinement. Grain refinement refers to a method to control grain size at high temperatures by introducing small precipitates in the microstructure, which will restrict the mobility of the grain boundaries and thereby will reduce the austenite grain growth during hot working or heat treatment. A small austenite grain size is known to improve the mechanical properties of the martensitic microstructure formed upon hardening. The steel comprises a second type of precipitations comprising carbides of at least one selected from the group consisting of Cr, Mo and V. These precipitations together with the first type of precipitations comprising Al and Ni give improved mechanical properties.

Cobalt (Co): 0-0.03 wt %. In one embodiment the amount of Co less than 0.03 wt %. In one embodiment the amount of Co less than 0.02 wt %. In another embodiment the amount of Co is less than 0.01 wt %. It has been proposed that cobalt should be labelled as carcinogenic category 1B H350 with a specific concentration limit (SCL) of 0.01 wt %, i.e. a cobalt content of more than 0.01 wt % could potentially be harmful. A low cobalt content is desired and in yet another embodiment the amount of Co is less than 0.005 wt %. In one embodiment there is a lower limit of Co of 0.0001 wt %. It is an advantage of the invention that it is possible to have a very low amount of cobalt while the desired properties remain. The amount of cobalt is or can at least be made so low that the steel can be called cobalt free. The low amount of cobalt does not give impaired properties in other respects such as mechanical properties or strength at high temperature.

Manganese (Mn): 0-0.5 wt %. Mn is an austenite phase stabilizing alloying element. However, if the Mn-content is excessive, the amount of retained austenite phase may become too large and various mechanical properties, as well as hardness and corrosion resistance, may be reduced. Also, a too high content of Mn will reduce the hot working properties and also impair the surface quality. In one embodiment Mn is 0-0.3 wt %. In one embodiment the lower limit of Mn is 0.001 wt %. The mentioned concentrations of Mn do not adversely affect the properties of the precipitation hardening steel to a noticeable extent. Mn is a common element in steel in low concentrations. Regarding Mn the skilled person must consider that it affects the total amount of $Ni_{eq}$ and the skilled person then may have to adapt the concentration of other nickel equivalents. The same applies to all other nickel equivalents.

Silicon (Si): 0-0.3 wt %. Si is a strong ferrite phase stabilizing alloying element and therefore its content will also depend on the amounts of the other ferrite forming elements, such as Cr and Mo. Si is mainly used as a deoxidizer agent during melt refining. If the Si-content is excessive, ferrite phase as well as intermetallic precipitates may be formed in the microstructure, which will reduce various mechanical properties. Accordingly, the Si-content is set to be max 0.3 wt %. In one embodiment the amount of Si is 0-0.15 wt %. In one embodiment the lower limit of Si is 0.001 wt %.

Optionally small amounts of other alloying elements may be added to the precipitation hardening steel as defined hereinabove or hereinafter in order to improve e.g. the machinability or the hot working properties, such as the hot ductility. Example, but not limiting, of such elements are Ca, Mg, B, Pb and Ce. The amounts of one or more of these elements are of max. 0.05 wt %.

When the terms "max" or "less than or equal to" are used, the skilled person knows that the lower limit of the range is 0 wt % unless another number is specifically stated.

The remainder of elements of the precipitation hardening steel as defined hereinabove or hereinafter is Iron (Fe) and normally occurring impurities. Examples of impurities are elements and compounds which have not been added on purpose, but cannot be fully avoided as they normally occur as impurities in e.g. the raw material or the additional alloying elements used for manufacturing of the precipitation hardening steel.

The term "impurity elements" is used to include, in addition to iron in the balance of the alloy, small amounts of impurities and incidental elements, which in character and/or amount do not adversely affect the advantageous aspects of the precipitation hardening steel alloy. The bulk of the alloy may contain certain normal levels of impurities, examples include but are not limited to up to about 30 ppm each of nitrogen, oxygen and sulfur.

In one embodiment the precipitation hardening steel comprises a first type of precipitations comprising Al and Ni and a second type of precipitations comprising carbides of at least one selected from the group consisting of Cr, Mo and V. The two types of precipitations give improved mechanical properties.

In a second aspect there is provided a method of manufacturing a part of the precipitation hardening steel as described above wherein the precipitation hardening steel is tempered at 510-530° C. to obtain precipitates comprising Ni and Al. This gives the precipitations comprising Al and Ni. In one embodiment the precipitation hardening steel is tempered at 520° C. In another embodiment the precipitation hardening steel is tempered at 520° C.±2%. In one embodiment the precipitation hardening steel is tempered for 1-8 hours. In one embodiment the precipitation hardening steel is tempered for 6-8 hours. In yet another embodiment the precipitation hardening steel is tempered at 6 hours±0.5 hours.

In one embodiment the precipitation hardening steel is machined before the tempering. This has the advantage that the precipitation hardening steel has lower strength before the tempering compared to after the tempering and is thereby easier to machine before the tempering compared to after the tempering. The increase in hardness during tempering at 520° C. can be seen in FIG. 1. For a steel that has essentially the same content except for Al (steel1), there is virtually no increase in hardness, whereas for a steel according to the invention an increase in hardness can be seen reaching a maximum around 6 hours. The increase in hardness is attributed to the formation of precipitates comprising Ni and Al. Steel with either secondary hardening elements or Ni—Al addition has limited hardness after tempering at 520° C. (steel2).

In one embodiment solution treatment is carried out before the tempering. In one embodiment the solution treatment is carried out in the temperature interval 900-1000° C. during 0.2-3 h. The composition should be chosen so that a solution treatment is possible in the austenitic phase field. Cr, Al, and Mo stabilizes ferrite whereas Mn and Ni stabilizes austenite. The invented steel secures an austenitic phase field suitable for hardening.

Figure 3:
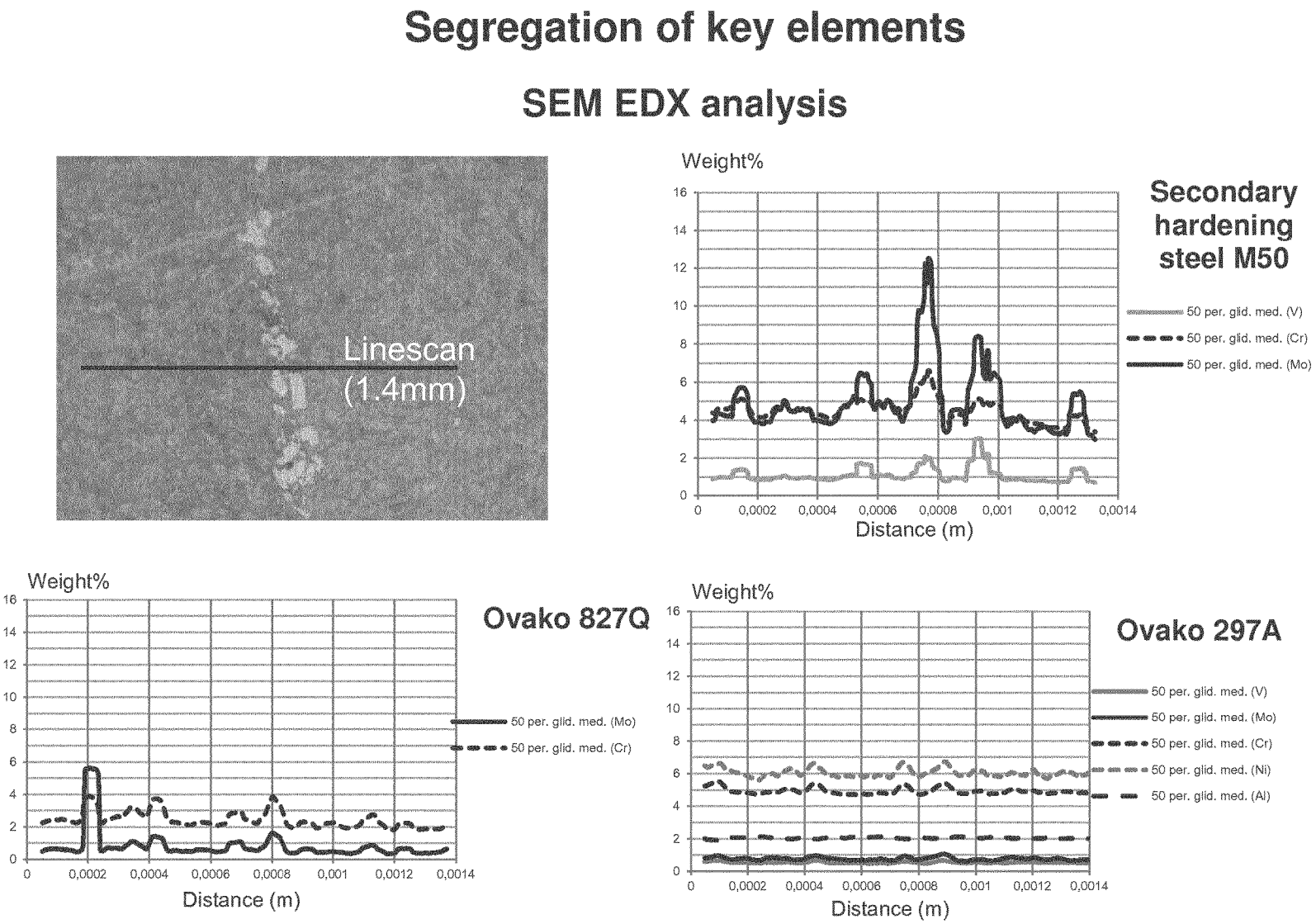
FIG. 3 shows a comparison of segregation of the invented precipitation hardening steel as well as two steels normally used at elevated temperature. 297A is according to the present invention. The two latter are not according to the invention (AISI M50 and Ovako 827Q).
Figure 4:
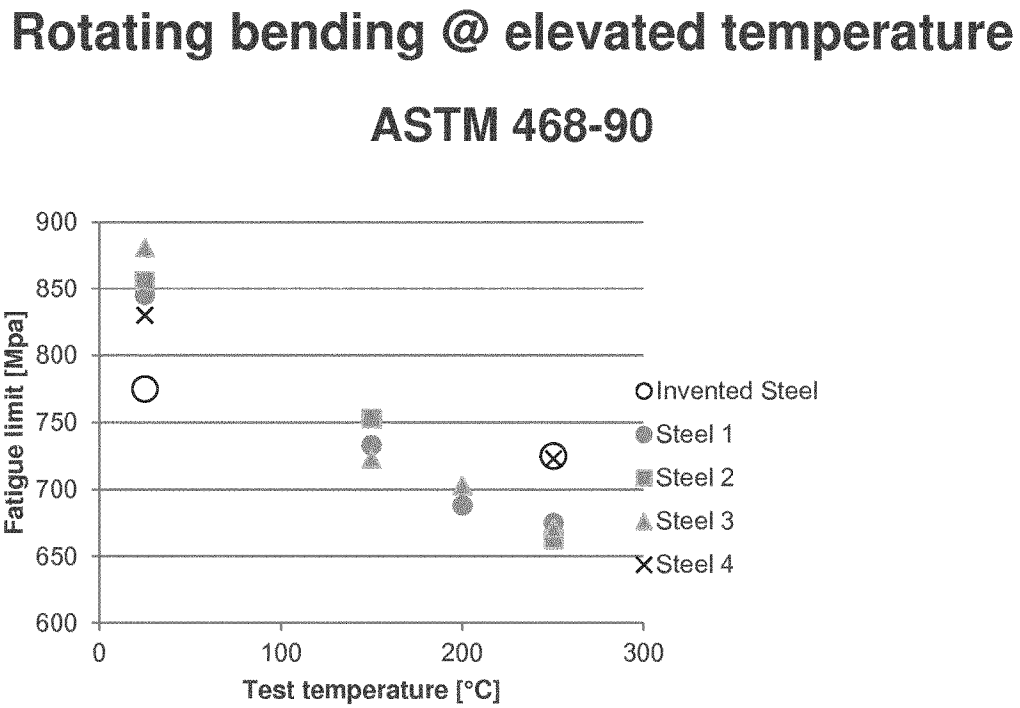
FIG. 4 shows a plot of the fatigue limit in MPa for rotating bending at elevated temperature according to ASTM 468-90 as a function of the test temperature for various types of steels. The composition is given for the invented precipitation hardening steel as well as for tested steels. The invented precipitation hardening steel has the same fatigue limit (about 725 MPa) as steel 4 (AISI M50) at 250° C.

In one embodiment the fatigue limit according to ASTM 468-90 at 250° C. is more than 700 MPa. From FIG. 4 it can be seen that a steel according to the invention has the same fatigue limit at 250° C. as AISIM50 (steel 4). However the AISA M50 steel has high segregation whereas the invented steel has low segregation as seen in FIG. 3.

Figure 5:
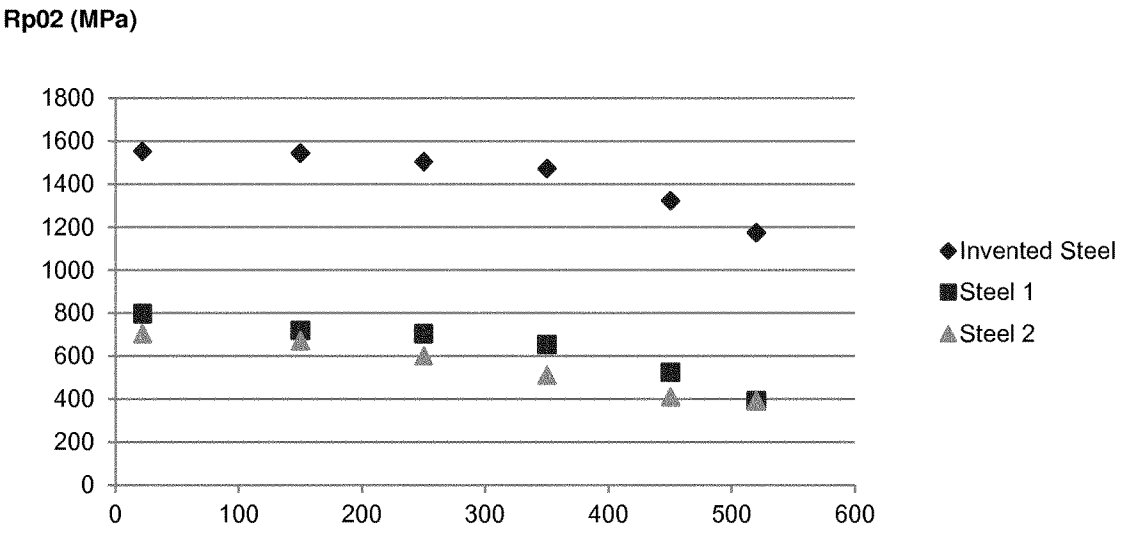
FIG. 5 shows a graph of the yield strength Rp02 in MPa as a function of temperature measured according to SS-EN ISO 6892-2:2011 for the precipitation hardening steel according to the invention and EN 100Cr6 (steel1) and EN 42CrMo4 (steel2) the two latter not according to the invention.

In a third aspect there is provided use of the as described above for applications where the steel is subjected to a temperature during use from 250 to 300° C. In an alternative embodiment there is provided use of the steel described above for applications where the steel is subjected to a temperature during use from 300 to 500° C. In yet another embodiment there is provided use of the steel as described above for applications where the steel is subjected to a temperature during use from 250-500° C. In a further embodiment there is provided use of the steel as described above for applications where the steel is subjected to a temperature during use from 250-450° C. From FIGS. 4 and 5 it can be seen that the fatigue limit and the yield strength is high also at elevated temperatures.

Regarding the formula Al=Ni/3, assuming that Ni=9 wt % then 3 wt % Al should be used. The two conditions taken together give that the amount of Al should be between 2.5 and 3 wt % in this particular example. If the endpoint of the Al interval (i.e. 3 wt %) is reached the maximum value of that element should be selected (i.e. 3 wt % Al). The invented steel secures an austenitic phase field suitable for hardening.

Assuming that Ni=6.5 wt %, then this formula gives that Al=2.1666 . . . ±0.5 wt %. I.e. between 1.666 . . . and 2.666 . . . wt %. I.e. with one decimal between 1.7 and 2.7 wt %. Assuming that Ni=3 wt %, then Al=1±0.5 wt %. I.e. 1-1.5 wt % taking into account all conditions.

The precipitation-hardening process can be proceeded by solution treatment, or solutionizing, is the first step in the precipitation-hardening process where the alloy is heated above the solidus temperature until a homogeneous solid solution is produced.

Figure 6:
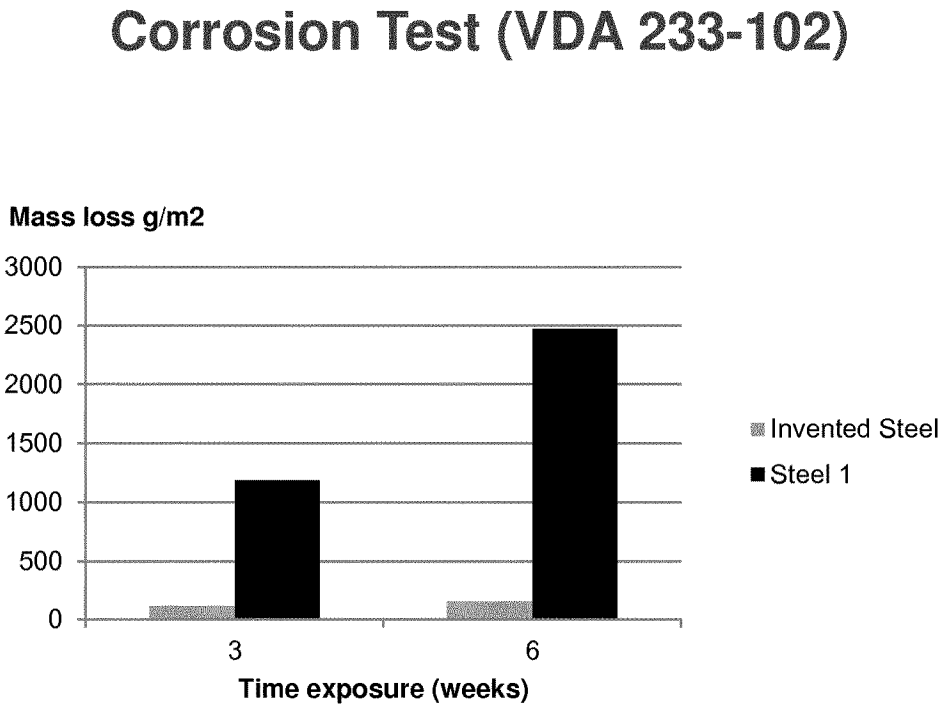
FIG. 6 shows the test results of a corrosion test according to VDA 233-102. The mass loss in g/m2 for steel 1 100Cr6 and a precipitation hardening steel according to the invention at 3 and 6 week respectively is shown.

The corrosion properties are improved. According to a corrosion test performed according to VDA 233-102 the corrosion properties are better for the invented steel compared to 100Cr6 (steel1). The data is shown in FIG. 6.

Nitriding is a heat treating process that diffuses nitrogen into the surface of a metal to create a case-hardened surface. The content of Cr, Mo and Al makes the steel suitable for nitriding. The nitriding is suitably used for further improving the mechanical properties. In one embodiment nitriding of the steel is carried out.

All the described alternative embodiments above or parts of an embodiment can be freely combined without departing from the inventive idea as long as the combination is not contradictory.

Other features and uses of the invention and their associated advantages will be evident to a person skilled in the art upon reading the description and the examples.

It is to be understood that this invention is not limited to the particular embodiments shown here. The embodiments are provided for illustrative purposes and are not intended to limit the scope of the invention since the scope of the present invention is limited only by the appended claims and equivalents thereof.

The invention claimed is:

1. A precipitation hardening steel with the composition:

C: 0.05-0.30 wt %

Ni: 4-8 wt %

Mo: 0.5-1.5 wt %

Al: 1.8-3 wt %

Cr: 2-14 wt %

V: 0.25-1.5 wt %

Co: 0-0.03 wt %

Mn: 0-0.3 wt %

Si: 0-0.3 wt % remaining part up to 100 wt % is Fe and impurity elements, with the additional proviso that the amounts of Al and Ni also fulfil a formula Al=(Ni/3)±0.5 in wt %, and with the proviso that the amount of Al is ±1.8 wt % if the formula results in an amount of Al lower than ±1.8 wt % and that the amount of Al is 3 wt % if the formula results in an amount of Al exceeding 3 wt % wherein the precipitation hardening steel comprises a first type of precipitations comprising Al and Ni and a second type of precipitations comprising carbides of at least one selected from the group consisting of Cr, Mo and V wherein the precipitation hardening steel optionally comprises Ca, Mg, B, Pb, Ce in amounts of maximum 0.05 wt %, wherein impurities of nitrogen, oxygen, and sulfur are limited to 30 ppm each.

2. The precipitation hardening steel according to claim 1, wherein the amount of Co is less than 0.01 wt %.

3. The precipitation hardening steel according to claim 1, wherein the amount of Cr is 2-10 wt %.

4. The precipitation hardening steel according to claim 1, wherein the precipitation hardening steel has a fatigue limit according to ASTM 468-90 at 250° C. of more than 700 MPa.

5. The precipitation hardening steel according to claim 1, wherein the precipitation hardening steel is nitrided.

6. The precipitation hardening steel according to claim 1, wherein:

C is 0.2 wt %

Ni is 6 wt %

Mo is 0.7 wt %

Al is 2 wt %

Cr is 5 wt %

V is 0.5 wt %

Mn is 0.3 wt %

Si is 0.1 wt %.

7. A method of manufacturing a part of the precipitation hardening steel according to claim 1 wherein the precipitation hardening steel is tempered at 510-530° C. for 1-8 hours to obtain precipitates comprising Ni and Al.

8. The method according to claim 7, wherein the precipitation hardening steel is tempered for 6-8 hours.

9. The method according to claim 7, wherein the precipitation hardening steel is machined before the tempering.

10. The method according to claim 7, wherein solution treatment is carried out before the tempering.

11. The method according to claim 10, wherein the solution treatment is carried out in the temperature interval 900-1000° C. during 0.2-3 h.

12. The method according to claim 7, wherein nitriding is carried out.

* * * * *